US006427804B1

(12) United States Patent
Lazarus

(10) Patent No.: US 6,427,804 B1
(45) Date of Patent: Aug. 6, 2002

(54) STEP-UP STOOL

(75) Inventor: Mark James Lazarus, Newport (GB)

(73) Assignee: Innovations for Trade and Technology, Essex (GB)

( * ) Notice: Subject to any disclaimer, the term of this patent is extended or adjusted under 35 U.S.C. 154(b) by 0 days.

(21) Appl. No.: 09/637,703

(22) Filed: Aug. 15, 2000

(51) Int. Cl.[7] ..... E04G 1/34; E06C 1/00
(52) U.S. Cl. ..... 182/153; 182/165
(58) Field of Search ..... 182/153, 224, 182/225, 226, 155, 186.1, 186.2, 186.5, 181.1, 165; D25/64, 65

(56) References Cited

U.S. PATENT DOCUMENTS

| | | | | | |
|---|---|---|---|---|---|
| 1,001,344 | A | * | 8/1911 | Boyer | 182/153 |
| 1,226,112 | A | * | 5/1917 | Pepin | 182/153 |
| 1,380,718 | A | * | 6/1921 | Herman | 182/155 |
| 1,935,871 | A | * | 11/1933 | Coffed et al. | 182/155 |
| 2,129,401 | A | * | 9/1938 | Botinger et al. | 182/165 |
| 2,207,923 | A | * | 7/1940 | Kelso | 182/153 X |
| 3,058,542 | A | * | 10/1962 | Rogalla | 182/155 X |
| 3,286,788 | A | * | 11/1966 | Swanson | 182/155 |
| 4,043,277 | A | | 8/1977 | Wallace | |
| 4,249,636 | A | * | 2/1981 | Jackson et al. | 182/225 X |
| 4,320,817 | A | | 3/1982 | Knoke et al. | |
| 4,640,386 | A | * | 2/1987 | Hall | 182/155 |
| 4,681,187 | A | * | 7/1987 | Brown | 182/153 X |
| 4,715,296 | A | | 12/1987 | Wikinson | |
| 5,092,427 | A | * | 3/1992 | Mac Millan | 182/186.1 X |
| 5,287,946 | A | * | 2/1994 | Mayo | 182/165 |
| 5,377,779 | A | * | 1/1995 | Slapnicka | 182/153 |
| 5,628,382 | A | * | 5/1997 | Hill | 182/153 |
| 5,704,662 | A | | 1/1998 | Kwiatkowski | |
| 5,720,362 | A | | 2/1998 | Denkins | |
| 5,878,839 | A | * | 3/1999 | Lin | 182/181.1 |
| 5,954,156 | A | * | 9/1999 | Cooke | 182/153 |
| 5,967,255 | A | | 10/1999 | Young | |

FOREIGN PATENT DOCUMENTS

| | | | | |
|---|---|---|---|---|
| FR | 137589 6 | | 2/1965 | |
| GB | 2163206 | * | 2/1986 | 182/225 X |
| GB | 218738 1 | | 9/1987 | |
| GB | 218738 1 A | | 9/1987 | |
| GB | 50454 8 A1 | | 9/1992 | |
| GB | 23310 08 A | | 11/1997 | |
| GB | 233100 8 | | 5/1999 | |

* cited by examiner

*Primary Examiner*—Daniel P. Stodola
*Assistant Examiner*—Hugh B. Thompson

(57) ABSTRACT

A step-up stool comprising a platform and at least three legs extending downwardly from the platform, wherein the length of each leg is individually and/or separately adjustable, and wherein the stool is collapsible to a substantially flat state. The step-up stool, therefore, provides a safe platform on which a tradesman can stand particularly on uneven ground, whilst also being easily collapsible, thereby being easy to carry around and to store.

8 Claims, 12 Drawing Sheets

STEP-UP STOOL

BACKGROUND OF THE INVENTION

1. Field of the Invention

The present invention relates to a step-up stool with extendible legs, and in particular to a step-up stool that is collapsible such that it can be flat-packed, while maintaining its rigidity when in use.

2. Description of Related Art

The majority of tradesman such as painters, plasterers, decorators, electricians, plumbers, bricklayers, carpenters and the like, often need to reach up to, and work at, places that are high off the ground. Commonly, these tradesman use step ladders which they either need to carry around with them, or which have to be borrowed at the site at which they are working. Step ladders are, however, very cumbersome and awkward to use, particularly on uneven surfaces.

Alternatively, the tradesman will use a simple hop-up of some sort, such as a milk crate or a wooden horse, examples of which can be seen in FIG. 1. Such hop-ups are similarly awkward to use, requiring good balance and little movement when being stood upon.

UK Patent Application No. 9723169.0 discloses a step-up stool with extendible legs. The stool providing a safe platform, due to the fact that each leg is individually extendible, for a tradesman to step onto and work from, even when the ground below is uneven. The stool disclosed, however, is not collapsible and is, therefore, quite awkward to carry around and store with the rest of the tradesman's tools.

SUMMARY OF THE INVENTION

The present invention seeks to alleviate the aforementioned disadvantages by providing a step-up stool comprising a platform, and at least three legs extending downwardly from the platform, wherein the length of each leg is individually and/or separately adjustable, and wherein the stool is collapsible to a substantially flat state.

Advantageously, the platform is generally rectangular, and there are four legs positioned respectively adjacent to the comers of the platform.

Preferably, the step-up stool has at least two elongate members extending between two of the legs, each elongate member being hingedly attached to at least one of the legs.

It is preferred that the platform is hingedly attached to at least one leg.

BRIEF DESCRIPTION OF THE DRAWINGS

The present invention will now be described, by way of example, with reference to the accompanying Figures in which.

DETAILED DESCRIPTION OF PREFERRED EMBODIMENTS

Figure 1A:
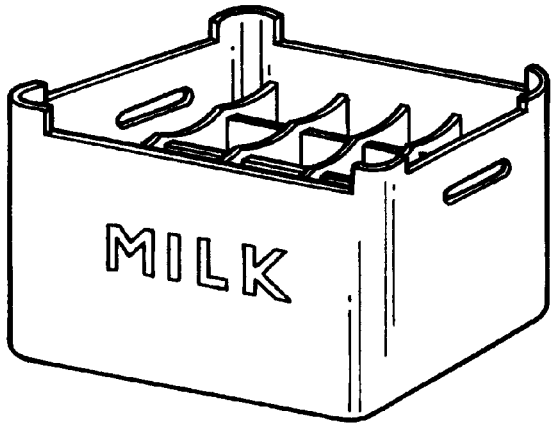
FIGS. 1(*a*) and 1(*b*) show examples of prior art items used as step-up stools.
Figure 1B:
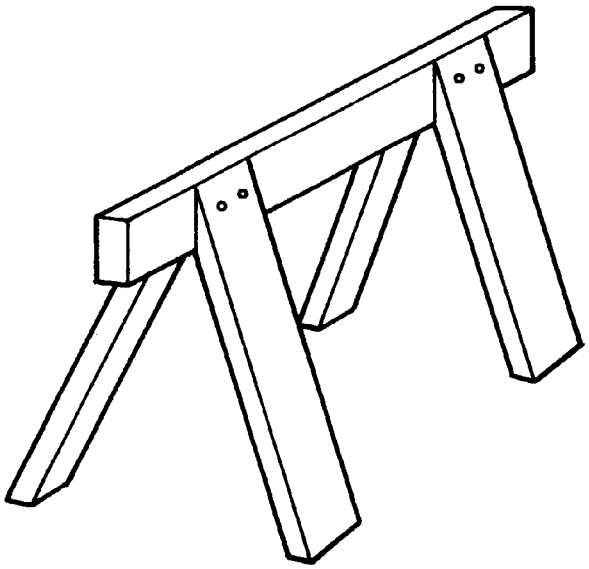
Figure 2:
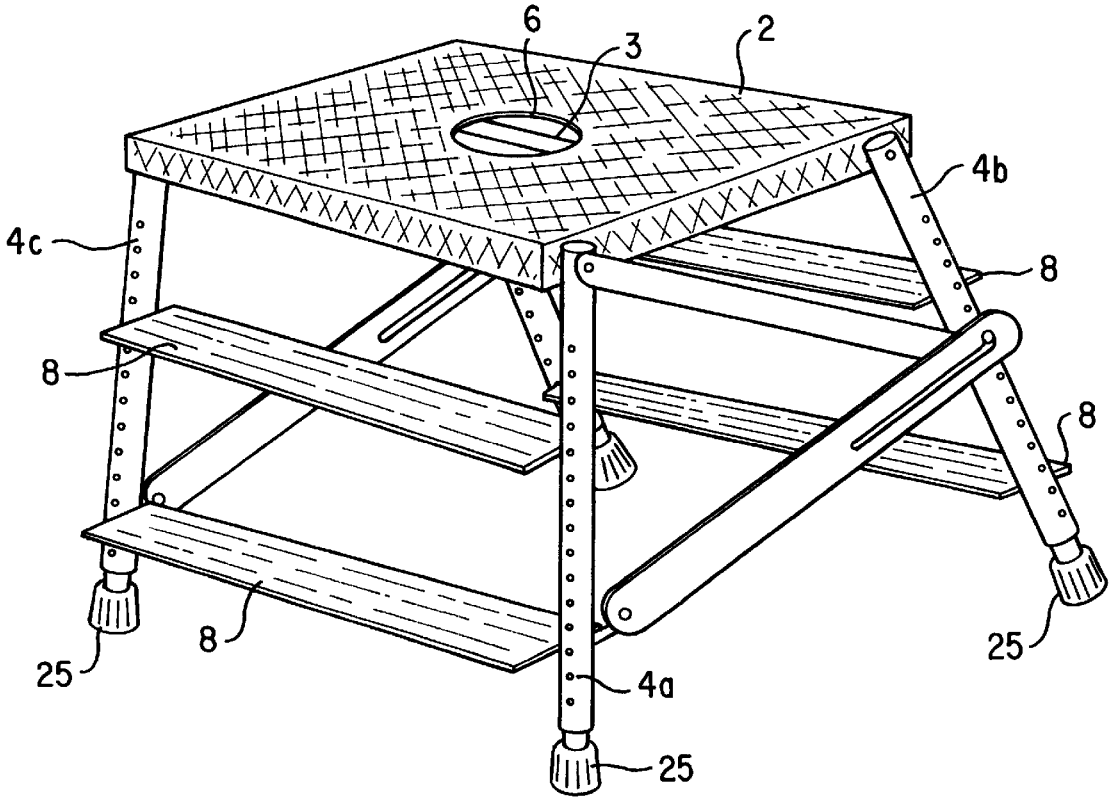
FIG. 2 is a perspective view of a first form of a step-up stool constructed in accordance with the invention.

Referring to FIG. 2, a step-up stool comprises a rectangular platform 2, from the comer regions of which four legs 4*a*, 4*b*, 4*c* and 4*d* downwardly extend. Each leg 4*a*, 4*b*, 4*c*, 4*d* is hingedly attached, at one end, to the platform 2. The platform 2 has an aperture 3, across a diameter of which extends a rod-like member to form a handle 6 in the platform. A pair of slats 8 are fixed between the legs 4*a* and 4*c*, a second pair of slats 8 being fixed between the other two legs 4*b* and 4*d*. The slats 8 constitute steps for facilitating step up access to the platform 2.

Figure 5A:
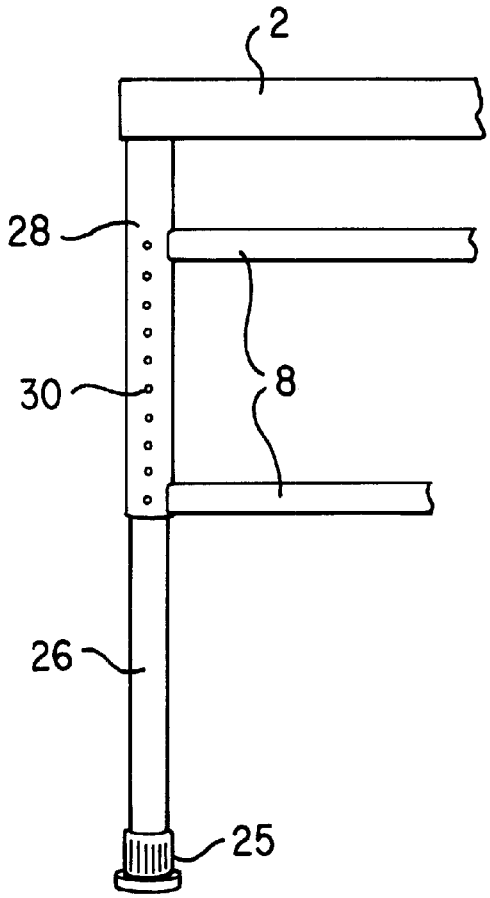
FIGS. 5(*a*), 5(*b*) and 5(*c*) illustrate how legs of the step-up stool can be extended.
Figure 5B:
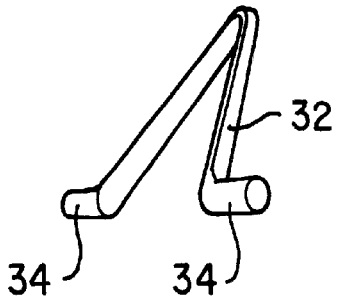
Figure 5C:
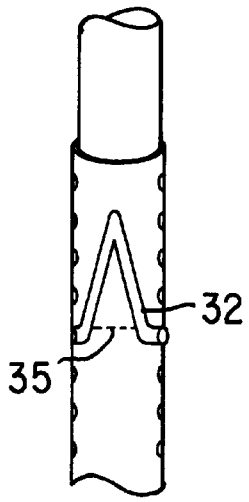

Referring now to FIGS. 5(*a–c*), each individual leg 4*a*, 4*b*, 4*c*, 4*d* comprises a first tubular structure 26 formed slidable within a second tubular structure 28. Each second tubular structure 28 has a plurality of apertures 30 formed in its surface (see FIG. 5(*a*), and each first tubular structure 26 has a resilient V-shaped spring clip 32 (see FIG. 5(*b*) located within its upper end 35. Each spring clip 32 has two resilient ball-ended arms 34 formed integral therewith. Each spring clip 32 is located in the upper end of the respective first tubular structure 26, the V-shaped portion of the clip extending within the first tubular structure and fixed thereto by friction between the V-shaped portion and the inner surface of the tubular structure. The ball-ended arms 34 of each clip 32 extend across the respective upper end 35 of the first tubular structure 26.

The first tubular structure 26 of each leg 4*a*, 4*b*, 4*c*, 4*d* is mounted telescopically within the second tubular structure 28 of that leg, and is locked into position by means of the ball-ended arms 34 of the associated clip 32, which arms protrude through the apertures 30 of that second tubular structure such that that first tubular structure extends beyond that second tubular structure to maintain that leg at the required length to provide sufficient height off the ground for the tradesman to work at (see FIG. 5(*c*). The ball-ended arms 34 of each clip 32 can be pushed back through the respective apertures 30 in order to allow telescopic movement of the associated first tubular structure 26 relative to the corresponding second tubular structure 28.

Figure 3:
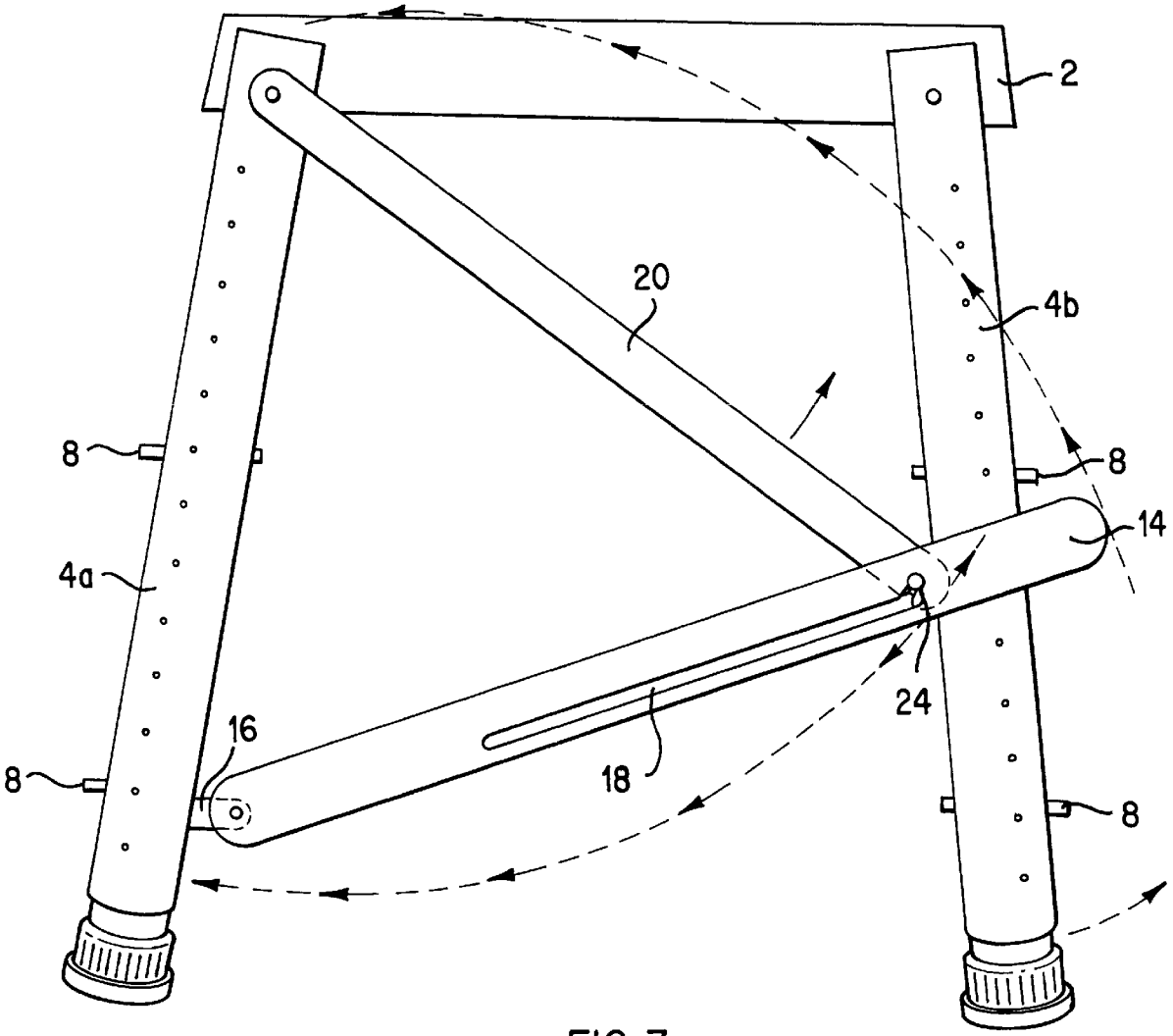
FIG. 3 is a side view of the step-up stool of FIG. 2, illustrating its 15 collapsibility.

Referring now to FIG. 3, which illustrates a side view of the step-up stool of FIG. 2, showing legs 4*a* and 4*b*. A first elongate member 14 extends between the legs 4*a*, 4*b*. The leg 4*a* has bracket 16 at is distal end, which bracket extends towards the other leg 4*b*. The bracket 16 has an aperture at its distal end. The first elongate member 14 has, at one of its ends, an aperture, the aperture having the same diameter as the aperture in the bracket 16. Thus, the first elongate member 14 is hingedly attachable to the leg 4*a* by a nut-and-bolt arrangement wherein the bolt is received through both the apertures in the first elongate member and the bracket 16. The first elongate member 14 is detachably 4 attached to the other leg 4*b* by means of an indent (not shown) formed within the first elongate member which receives an outwardly-extending protrusion (also not shown) formed on, and about half way up, the leg 4*b*. The first elongate member 14 can, therefore, be detached from the leg 4*b* by is releasing the protrusion from the indent. The first elongate member 14 has a closed-ended slot 18 formed along part of its length.

A second elongate member 20 is hingedly attached, at one of its ends, to the top proximal end of the leg 4*a*.The other end of the second elongate member 20 has an indent so as to form a claw 22. The claw end 22 of the second elongate member 20 receives a pin 24 that is located within the slot 18 of the first elongate member, and which is slidable along the entire length of that slot. As can be seen clearly in FIG. 3, the first elongate member 14 is angled upwardly when extending from leg the 4*a* to the leg 4*b*, whereas the second elongate member 20 is angled downwardly when extending from the leg 4*a* to the leg 4*b*. The combination of the first and second elongate members 14, 20, extending between each legs 4*a* and 4*b* at differing angles provides extremely good rigidity to the stool frame which is an important requirement when the stool is stood on for work purposes.

First and second elongate members are similarly attached to, and extend between, the other two legs 4*c* and 4*d*, not shown in FIG. 3.

Figure 4:
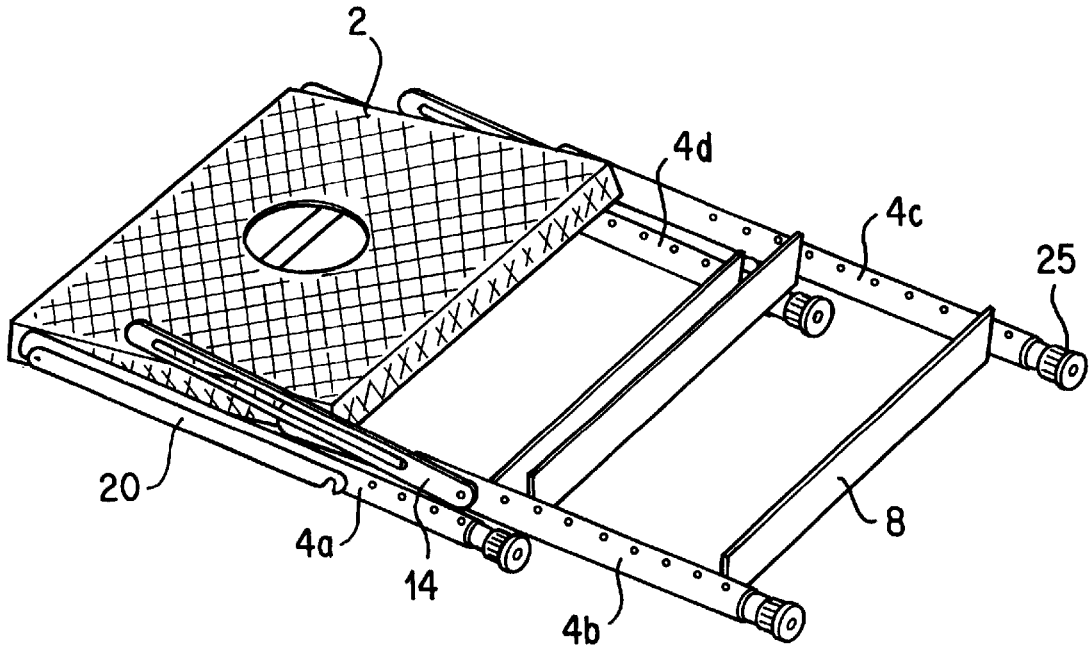
FIG. 4 is a perspective view of the step-up stool of FIG. 2 in its collapsed form.

When not in use, the stool can be collapsed flat by releasing the first elongate members 14 from the leg 4*b* and 4*d* and lifting the first elongate members, which pivot on the hinged bracket arrangements 16, until the first elongate members lie adjacent to, and parallel with the legs 4*a* and 4*c*. As the first elongate members 14 are lifted, the second elongate members 20 slide down within the slots 18 formed in the first elongate members, thus collapsing the entire stool. Once the ends of the slots 18 are reached, the clawed ends of the second elongate members 20 can be detached from the pins 24 such the second elongate members can be moved to a position adjacent to, and parallel with the legs 4*a* and 4*c*. In this position, the stool is collapsed flat, with legs 4*a*, 4*b* and legs 4*c* and 4*d* lying adjacent to, and substantially parallel with, one another respectively, and the platform 2 having pivoted to an axis substantially perpendicular that which it is when the stool is in use. The stool is its collapsed form can be clearly seen in FIG. 4.

Each leg 4*a*, 4*b*, 4*c*, 4*d* of the stool has, at its distal end, a rubber or plastics cap 25 to prevent damage to the ground on which the stool is placed.

Figure 6A:
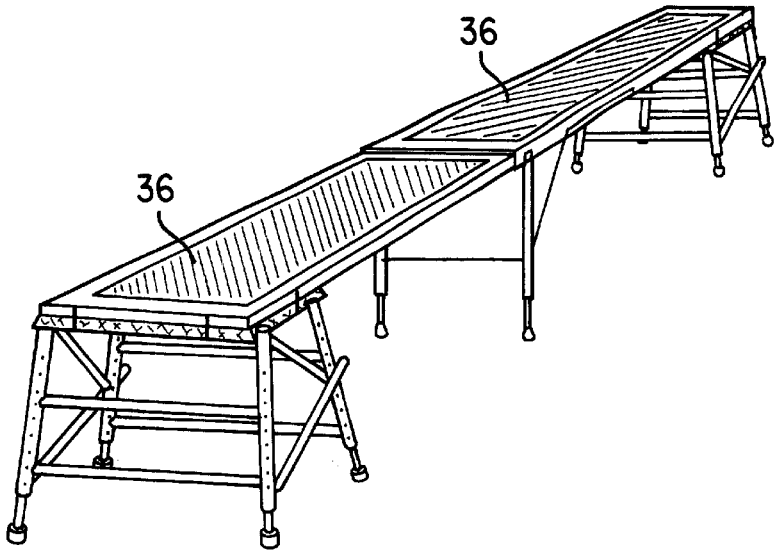
FIGS. 6(*a*), 6(*b*) and 6(*c*) show the step-up stool of FIGS. 1(*a*) and (*b*) used in conjunction with an adjustably attachable board.
Figure 6B:
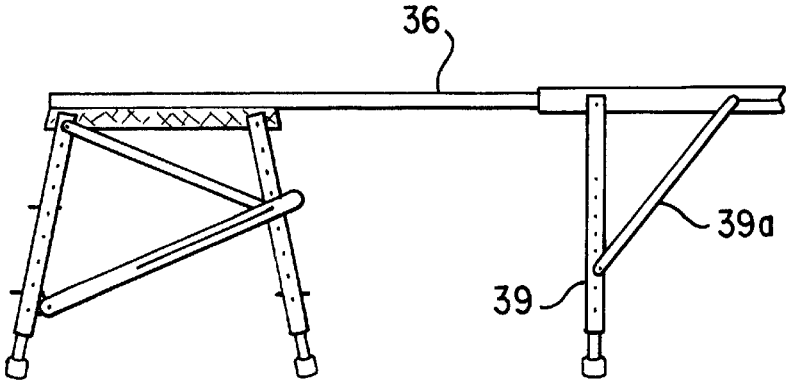
Figure 6C:
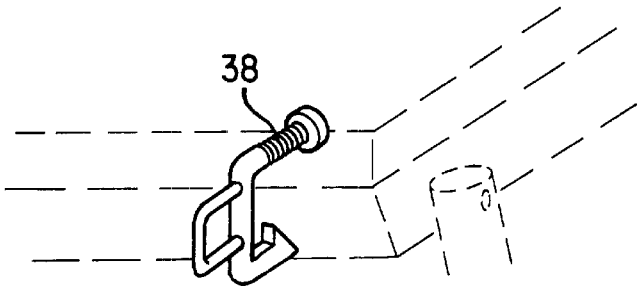
Figure 7A:
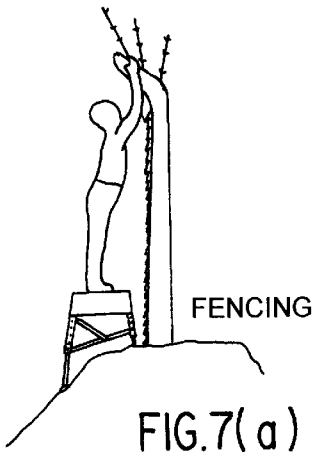
FIGS. 7(*a*), 7(*b*), 7(*c*), 7(*d*), 7(*e*), 7(*f*) illustrate how the step-up stool can be used in various trades.
Figure 7B:
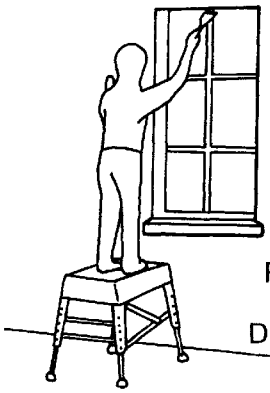
Figure 7C:
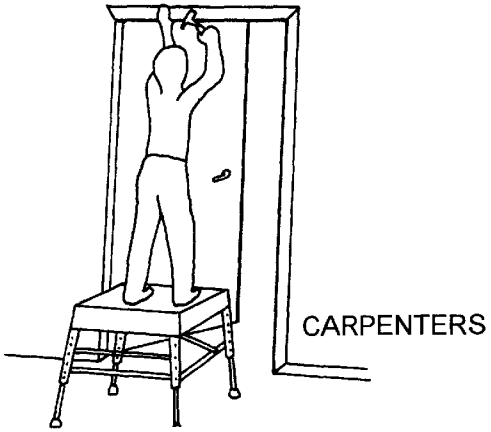
Figure 7D:
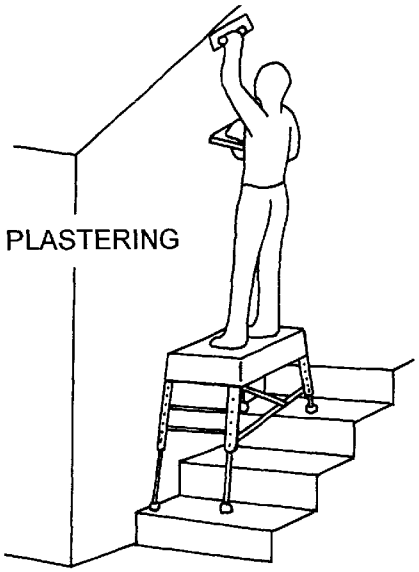
Figure 7E:
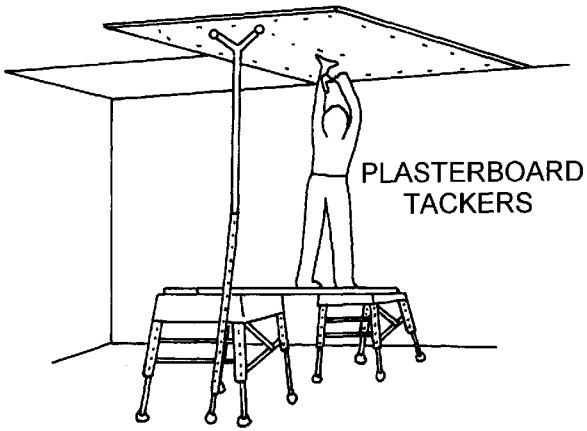
Figure 7F:
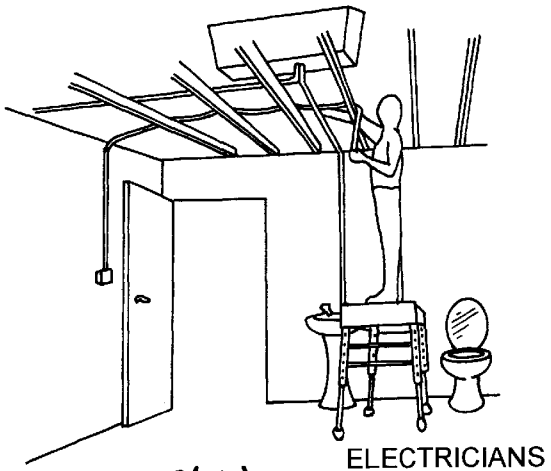

With reference to FIG. 6, the platform 2 on which the tradesman stands can be increased by the addition of a board 36 placed thereon, extending across the top of two or more stools (see FIGS. 6(*a*) and (*b*)). In this case, the board 36 may be attached to the, or each, stool, using a standard tradesman's clamp 38, as can be seen in FIG. 6(*c*). Further support might be required for the board 36, in the form of a further extendible leg 39 with a elongate member 39*a* attached to, and extending between, the leg and the board.

FIGS. 7(*a–f*) illustrate some of the many uses of the step-up stool including, amongst others, fencing, painting and decorating, carpentry, plastering, plasterboard tacking and electrical and plumbing work. Furthermore, due to the individual extendibility of each leg 4, the stool can be used for work on uneven ground and even stairs.

Figure 8:
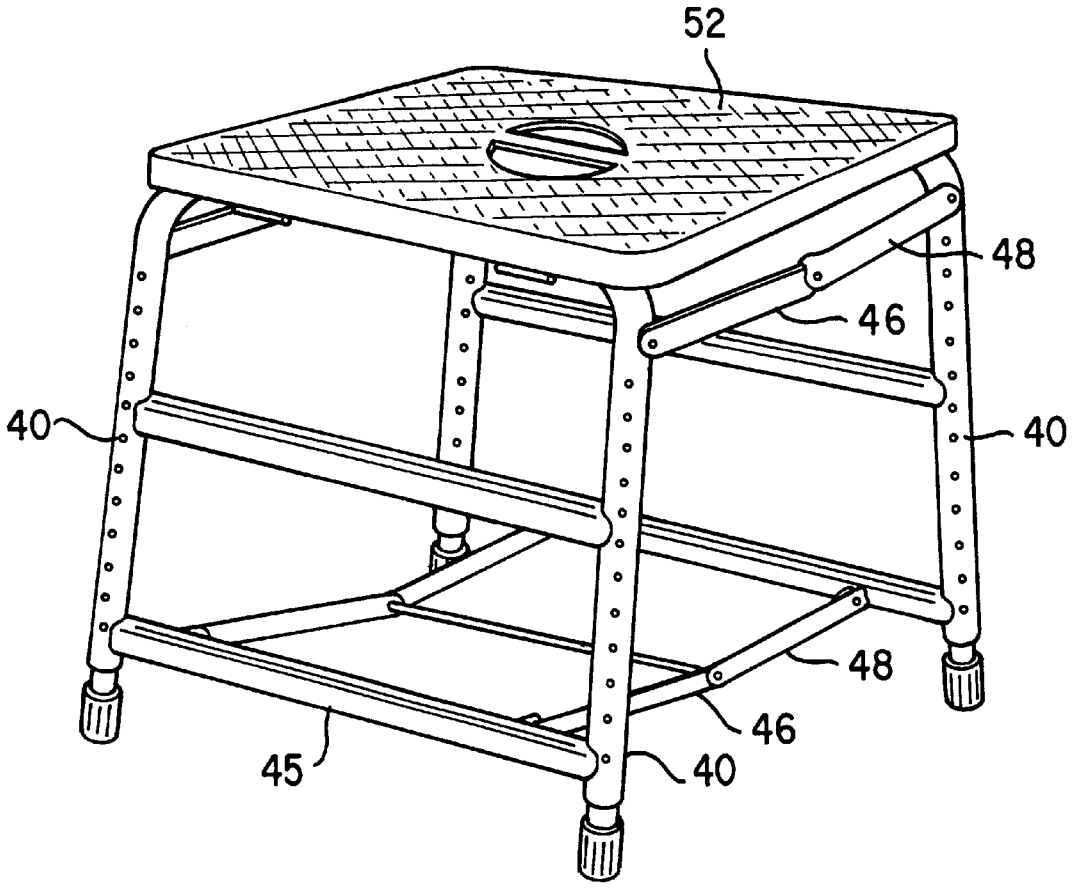
FIG. 8 is a perspective view of a second form of step-up stool constructed in 25 accordance with the invention.
Figure 9A:
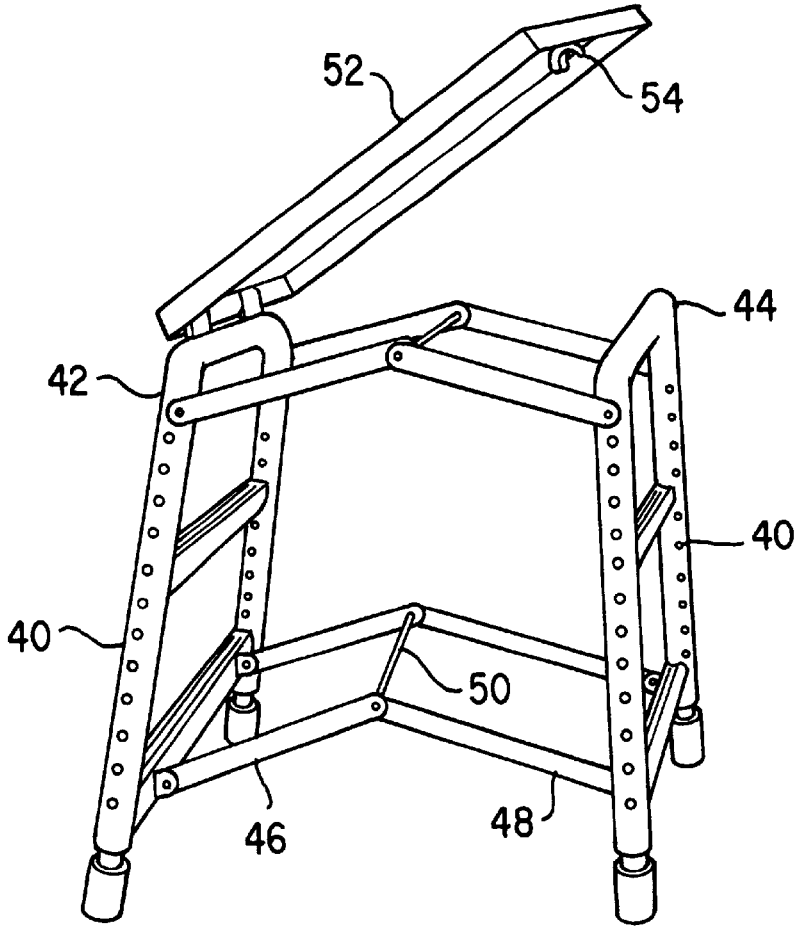
FIGS. 9(*a*) and 9(*b*) are a perspective view of the step-up stool of FIG. 8 illustrating its collapsibility.
Figure 9B:
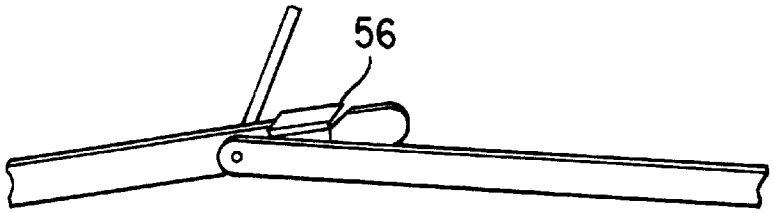

FIGS. 8, 9(*a*) and 9(*b*) show a second embodiment of the present invention. In this embodiment, the four legs 40 are formed from first and second tubular upturned substantially "U-shaped" members 42, 44. Each U-shaped member 42, 44 has two steps 45 extending between its two legs 40.

Two pairs of two elongate members 46, 48, hingedly attached together, extend between the tops and bottoms of the leg 40 of the two U-shaped members 42 and 44. The elongate members 46, 48 of each pair are attached to each other by means of a pin 50 that is received through apertures in the ends of each elongate member (see FIG. 9). A platform 52 is hingedly attached to the top of U-shaped member 42, and has a clip portion 54 with which to receive and connect to the other U-shaped member 44.

After use, the stool can be collapsed by unclipping the clip 54 of the platform 52 from the U-shaped member 44 and pushing the U-shaped members 42, 44 towards each other such that each elongate member 46, 48 moves to a position substantially parallel with its respective pair. The platform 52 may be connected to the U-shaped member 42 by means of a two-way hinge thereby allowing the platform to move to a position adjacent to, and parallel with, the U-shaped member 42 once it has been unclipped.

One of the elongate members 46 of each pair has a stop block 56 in order to prevent the hinge of that pair from working in the opposite direction to that which provides the 10 stools collapsibility. This is more clearly shown in FIG. 9(*b*).

Figure 10:
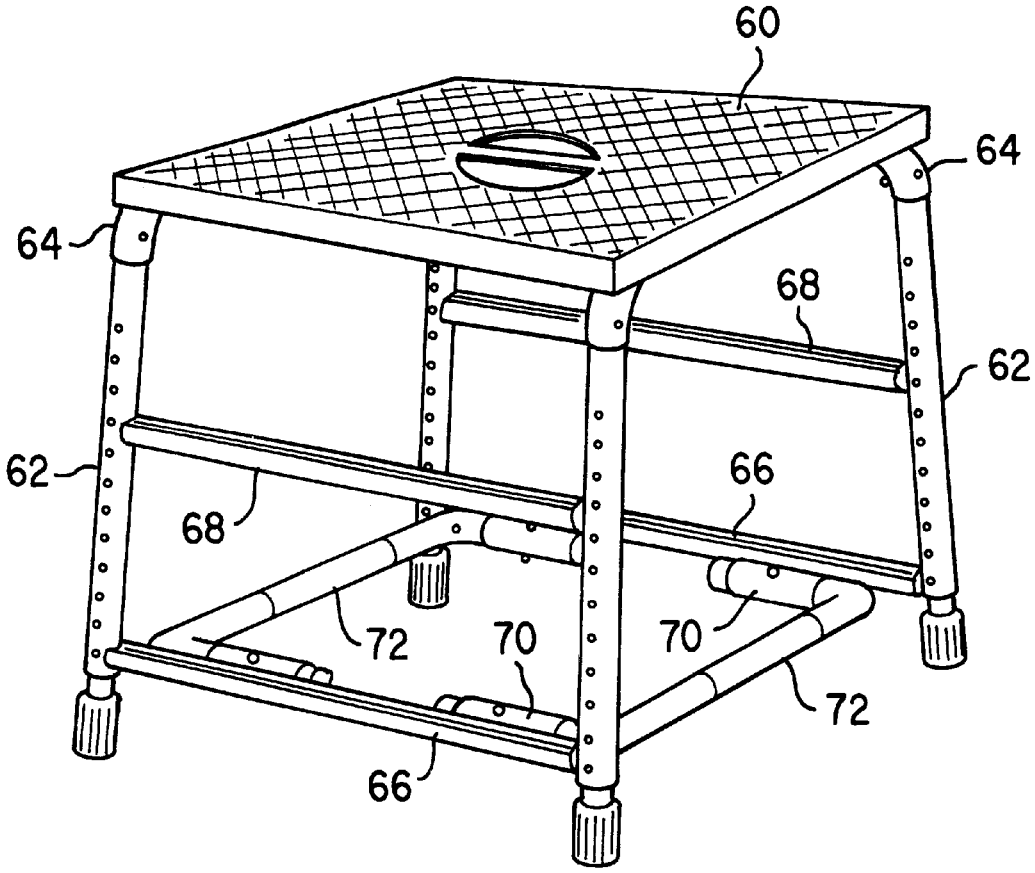
FIG. 10 is a perspective view of a third form of step-up stool constructed in accordance with the invention.
Figure 11:
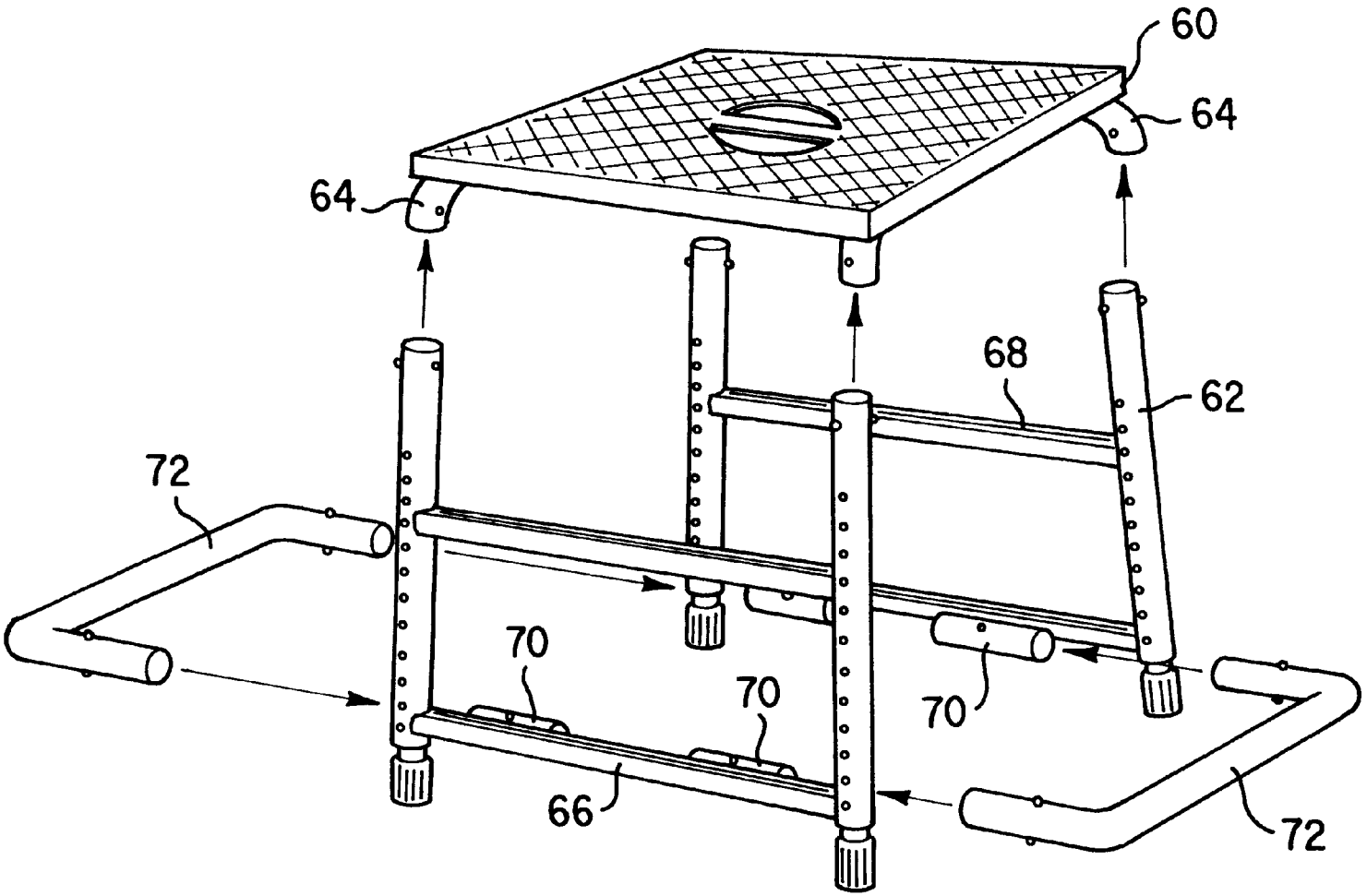
FIG. 11 illustrates the collapsible feature of the step-up stool of FIG. 10.
Figure 12B:
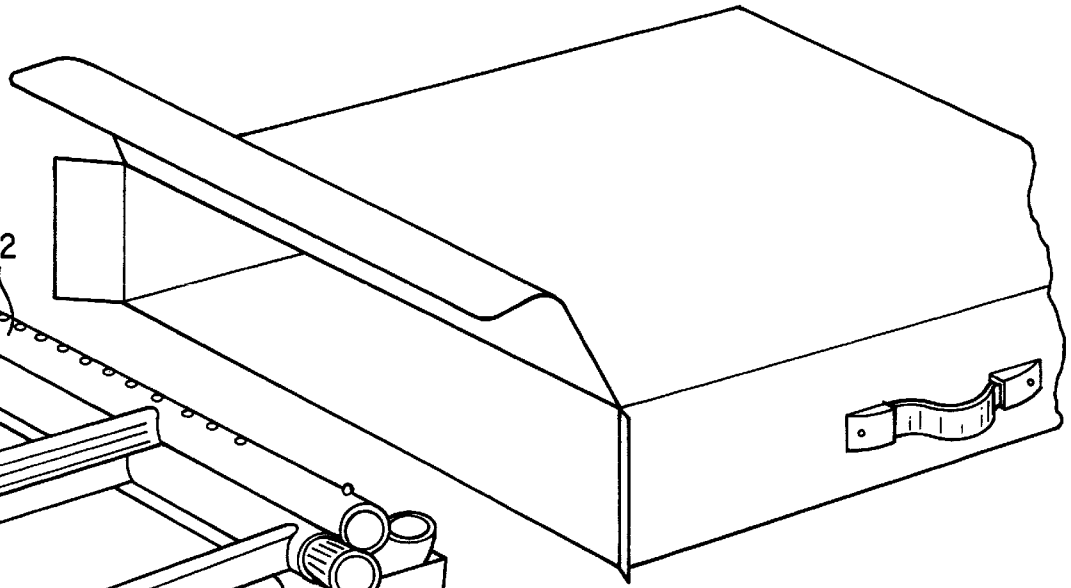
FIGS. 12(*a*) and 12(*b*) are perspective views of the step-up stool of FIG. 10 in its collapsed form.
Figure 12A:
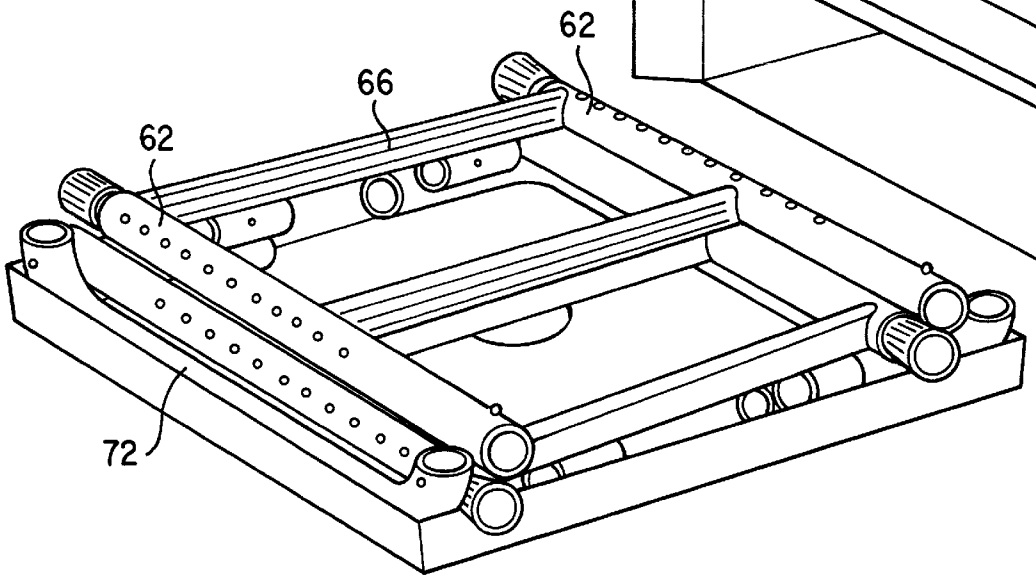

FIGS. 10 to 12(*a–b*) illustrate a third embodiment of the present invention. Here, the step-up stool comprises a platform 60, from which four extendible legs 62 downwardly extend, the legs being made up of two parallel pairs. Each leg 62 is attached to the platform 60 by means of tubular structures 64 formed integral with the platform, on the underside comers thereof, within which the legs 62 can slide. Each leg 62 has resilient spring members (not shown) protruding from the outside top region of the leg, the resilient members being received through apertures in the tubular structures 64 to attach the legs to the platform and lock them in place. Steps 66, 68, in the form of a slats, are located between opposite pairs of parallel legs 62. Each step 66 has two spaced-apart, tubular members 70 formed integral therewith. The ends of the tubular U-shaped members 72 are received within respective tubular members 70 formed on the steps 66. Each tubular U-shaped member 72 has resilient spring members (not shown) protruding from the outside of the end of both arms, the resilient members being received through apertures in the tubular structures 70 to attach the U-shaped tubular member 72 to the legs 62 and lock them in place (see FIGS. 10 and 11).

Once used, the stool can be collapsed by uncipping the platform 60 from the legs 62, and by unclipping the U-shaped tubular members 72 from the tubular structures 70 formed on the steps 66. The stool, in its collapsed form can be seen clearly in FIG. 12(*a*).

It will be appreciated that each further embodiment utilizes the extendible legs described previously with reference to the first embodiment.

The stools of each embodiment may be made from a number of materials, preferably those which are lightweight and strong, such as aluminum, hardened plastic, steel, UPVC, carbon fibre, fibre glass or graphite.

What is claimed is:

1. A step-up stool comprising:

a platform and at least three legs extending downwardly from the platform, wherein the length of each leg is individually adjustable, and wherein the stool is collapsible to a substantially flat state, wherein at least one first and one second elongate member extend between two of the legs, each of the first and second elongate members being hingedly attached to at least one of the two legs, wherein the respective first and second elongate members extend at different angles between the respective two legs, one end of each first elongate member being hingedly attached to one of the respective two legs, the other end of the first elongate member being detachably attached to the other one of the respective two legs, and the first elongate members each having a closed end slot formed therein, one end of each second elongate member being hingedly attached to one of the respective two legs, the other end of the second elongate member being detachably attached to a pin located within the slot of the respective first elongate member, the pins being slidable along the entire length of the slots when the first elongate member is detached from its respective one of the legs.

2. The step-up stool according to claim 1, comprising four legs positioned respectively adjacent to comers or borders of the platform.

3. The step-up stool according to claim 2, wherein the four legs are positioned so as to form first and second pairs of legs.

4. The step-up stool according to claim 2, wherein the four legs are formed from first and second tubular upturned substantially U-shaped members.

5. The step-up stool according to claim 4, wherein the platform is detachable from at least one of the legs.

6. The step-up stool according to claim 1, wherein the stool is in a collapsed form when each elongate member and each leg are moved to positions in which they are adjacent to, and substantially parallel with, one another.

7. The step-up stool according to claim 1, wherein the platform is hingedly attached to each of the legs.

8. The step-up stool according to claim 1, wherein the platform is detachable from each of the legs.

* * * * *

UNITED STATES PATENT AND TRADEMARK OFFICE

CERTIFICATE OF CORRECTION

PATENT NO. : 6,427,804 B1
DATED : August 6, 2002
INVENTOR(S) : Mark James Lazarus It is certified that error appears in the above-identified patent and that said Letters Patent is hereby corrected as shown below:

Title page,
Item [30], insert:
-- Foreign Application Priority Data
January 11, 2000 United Kingdom 0000557.9 --

Signed and Sealed this

Eighteenth Day of February, 2003

JAMES E. ROGAN
*Director of the United States Patent and Trademark Office*